US006589924B2

(12) United States Patent
Schmidt et al.

(10) Patent No.: US 6,589,924 B2
(45) Date of Patent: Jul. 8, 2003

(54) CLEANING TABLETS COMPRISING SULFAMIC ACID

(75) Inventors: Erik Schmidt, Thorso (DK); Anders Bjerre Kristensen, Silkeborg (DK); Bodil Hansen, Højbjerg (DK)

(73) Assignee: Cleantabs A/S, Hammel (DK)

( * ) Notice: Subject to any disclaimer, the term of this patent is extended or adjusted under 35 U.S.C. 154(b) by 0 days.

(21) Appl. No.: 09/950,826

(22) Filed: Sep. 13, 2001

(65) Prior Publication Data

US 2002/0058605 A1 May 16, 2002

Related U.S. Application Data

(60) Provisional application No. 60/232,851, filed on Sep. 15, 2000.

(51) Int. Cl.[7] ..... C11D 17/00

(52) U.S. Cl. ..... 510/191; 510/446; 510/447; 510/477; 510/478; 510/470; 510/494; 510/192; 510/495

(58) Field of Search ..... 510/238, 191, 510/192, 446, 447, 477, 478, 480, 494, 470, 455

(56) References Cited

U.S. PATENT DOCUMENTS 5,895,781 A 4/1999 Neumiller et al.

FOREIGN PATENT DOCUMENTS

| | | |
|---|---|---|
| DE | 32 09 333 A1 | 9/1983 |
| WO | 9932592 | 7/1999 |

*Primary Examiner*—Necholus Ogden
(74) *Attorney, Agent, or Firm*—Dykema Gossett PLLC

(57) ABSTRACT

Cleaning tablets made from a cleaning composition comprising
15–80% by weight of sulfamic acid having a particle size of from 0.4 to 1.4 mm
5–60% by weight of citric acid powder
10–30% by weight of sodium carbonate
2–10% by weight of a tabletting additive
up to 5% by weight of a tenside
up to 10% by weight of an additive selected from the group consisting of disinfectants and bleeching agents
up to 7% by weight of a disintegrating agent and
up to 5% by weight of conventional additives.

15 Claims, No Drawings

CLEANING TABLETS COMPRISING SULFAMIC ACID

The present application claims the benefit of the priority of U.S. Provisional Application No. 60/232,851, filed Sep. 15, 2000.

TECHNICAL FIELD

This invention relates to a cleaning composition suitable for tabletting and to tablets made from the composition, and in particular to tablets for use in cleaning ceramics and porcelain surfaces such as toilet bowls and cisterns.

BACKGROUND ART

The cleaning of the porcelain surfaces of toilets bowls requires cleaning compositions having specific properties. Thus, such cleaning compositions should be capable of removing lime and unwanted stains and loosening dirt from such surfaces. Furthermore, they should have a disinfecting effect.

Cleaning compositions in tablet form have several advantages over liquid and powered cleaning compositions. Thus, because they are compressed and contain no water they are economical for shipping and storage. Furthermore, they facilitate a correct dosing.

WO 99/32592 and the corresponding U.S. Pat. No. 5,895,781 disclose cleaning tablets for the cleaning of ceramic and porcelain surfaces and comprising from about 20 to about 80% by weight of sulfamic acid, from about 0.1 to about 20% by weight of isoascorbic acid for reducing kinetically inert metal coordination complex stains, a non-interfering surfactant system and a complexing system comprising from about 0.01 to about 10% by weight of ethylenediaminetetraacetic acid (EDTA) and from about 5 to about 45% by weight of citric acid.

The cleaning composition may also contain an effervescing agent, the most preferred effervescing agent being an alkali metal bicarbonate such as potassium and sodium bicarbonate.

The biodegradation of EDTA is slow and cleaning compositions containing EDTA are in many countries considered environmentally unacceptable.

DE 32 09 333 A1 discloses floatable cleaning tablets for the cleaning of toilet bowls having the following composition:

- 40–60% by weight of sulfamic acid
- 16–30% by weight of sodium carbonate or a mixture of sodium carbonate and sodium bicarbonate
- 0.05–6% by weight of an anionic and/or non-ionic tenside
- 10–20% by weight of a tabletting additive
- up to 15% weight of a chlorine-releasing disinfectant, and
- up to 10% of various additives such as dyes and fragrances.

Investigations of tablets according to DE 32 09 333 A1 have revealed that, although the initial strength of such tablets is high, they loose strength when stored for longer periods such as 4 weeks, and they become soft after storage for about 8 weeks at room temperature.

Furthermore, it has been found that such compositions tend to adhere to the dies and piston surfaces during the tabletting process and make the removal of the tablets from the dies difficult.

SUMMARY OF THE INVENTION

An object of the present invention is to provide cleaning compositions which are environmentally acceptable.

Another object of the invention is to provide cleaning compositions which can be removed from tabletting dies without difficulties, thereby allowing tabletting at normal production speeds such as 800–1000 tablets per minute using standard production rotary tabletting machines.

A further object of the invention is to provide cleaning tablets which maintain their strength and structure over long periods of storage and/or shipping.

Surprisingly, it has been found that the drawbacks of the prior art cleaning tablets can be reduced or even eliminated by preparing cleaning tablets from a cleaning composition containing relatively coarse particles of sulfamic acid, and additional acid component in the form of citric acid, and sodium carbonate as effervescent agent.

Thus, the cleaning composition of the invention comprises

- 15–80% by weight of sulfamic acid having a particle size of from 0.4 to 1.4 mm;
- 5–60% by weight of citric acid powder;
- 10–30% by weight of sodium carbonate;
- 2–10% by weight of a tabletting additive;
- up to 10% by weight of an additive selected from the group consisting of disinfectants and bleaching agents;
- up to 5% by weight of a tenside;
- up to 7% 7% by weight of a disintegrating agent, and
- up to 5% 5% by weight of conventional additives.

The invention is based on the discovery that the particle size of sulfamic acid plays an important role as far as the stability of the tabletted cleaning composition is concerned. Thus, by using sulfamic acid having a particle size of at least 0.4 mm instead of sulfamic acid having a particle size of 0.05–0.2 mm as disclosed in DE 32 09 333 A1, the tablet strength after 4 weeks of storage is significantly increased, cf. the following Table I, which illustrates the effect of varying particles size of sulfamic acid on tablet strength for cleaning tablets based on coarse and fine sulfamic acid particles.

TABLE I

| | % by weight | % by weight |
|---|---|---|
| Sulfamic acid, particle size ≦ 0.2 mm | 52.30 | — |
| Sulfamic acid, particle size ≧ 0.4 mm | — | 52.30 |
| Sodium carbonate | 26.18 | 26.18 |
| Sorbitol | 15.00 | 15.00 |
| Surfactant | 5.00 | 5.00 |
| Disintegrating agent | 0.50 | 0.50 |
| Dye | 0.02 | 0.02 |
| Paraffin oil | 1.00 | 1.00 |
| Total | 100 | 100 |
| Tablet Strength, N | | |
| New tablets | 268 | 159 |
| After 24 hours | 417 | 223 |
| After 2 weeks[1)] | 678 | 594 |
| After 4 weeks[1)] | 10 | 870 |
| After 8 weeks[1)] | — | 971 |
| After 8 weeks at room temperature | — | 630 |
| Disintegration Time, min. | | |
| New tablets | 3.00 | 2.33 |
| After 24 hours | 2.57 | 3.03 |
| After 2 weeks[1)] | 10.02 | 6.57 |
| After 4 weeks[1)] | 5.87 | 8.48 |
| After 8 weeks[1)] | — | 10.08 |
| After 8 weeks at room temperature | — | 5.43 |

[1)]Packed in a foil and stored at 75% relative humidity and 35° C.

As will appear from Table I, the strength of the tablets is significantly improved by substituting coarse sulfamic acid particles for fine sulfamic acid particles.

Also, the use of sodium carbonate as effervescent agent instead of sodium bicarbonate or potassium bicarbonate significantly increases the stability of the tablets in question.

This will appear from Table II, which illustrates the stability of a cleaning tablet according to the invention, tablet 1, and two similar cleaning tablets, tablets A and B, containing sodium bicarbonate and potassium bicarbonate, respectively, as effervescent agent.

TABLE II

| | Tablet No. 1 % by weight | Tablet A % by weight | Tablet B % by weight |
|---|---|---|---|
| Sulfamic acid particle size ≧ 0.4 mm | 52.63 | 52.63 | 52.63 |
| Citric acid | 10.00 | 10.00 | 10.00 |
| Sodium carbonate | 20.00 | — | — |
| Sodium bicarbonate | — | — | 20.00 |
| Potassium bicarbonate | — | 20.00 | — |
| Percarbonate | 2.00 | 2.00 | 2.00 |
| Dispersant | 2.00 | 2.00 | 2.00 |
| Surfactant | 2.00 | 2.00 | 2.00 |
| Binder | 5.25 | 5.25 | 5.25 |
| Disintegrating agent | 5.00 | 5.00 | 5.00 |
| Dye | 0.02 | 0.02 | 0.02 |
| Perfume | 0.10 | 0.10 | 0.10 |
| Paraffin oil | 1.00 | 1.00 | 1.00 |
| Total | 100.00 | 100.00 | 100.00 |
| Tablet Strength, N | | | |
| New tablets | 151 | 112 | 94 |
| After 24 hours | 209 | 103 | 178 |
| After 2 weeks[1)] | 372 | 26 | 36 |
| After 4 weeks[1)] | 316 | — | — |
| After 8 weeks[1)] | 245 | — | — |
| After 8 weeks at room temperature | 228 | — | — |
| Disintegration time, min. | | | |
| New tablets | 3.88 | 2.62 | 6.22 |
| After 24 hours | 5.03 | 2.87 | 10.67 |
| After 2 weeks[1)] | 9.85 | 2.03 | 7.58 |
| After 4 weeks[1)] | 11.03 | — | — |
| After 8 weeks[1)] | 11.08 | — | — |
| After 8 weeks at room temperature | 8.27 | — | — |

[1)]Packed in a foil and stored at 75% relative humidity and 35° C.

As will appear from Table II, the cleaning tablets containing sodium carbonate as effervescent agent are considerably more long-term stable than tablets containing potassium or sodium bicarbonate as effervescent agent.

The coarse sulfamic acid particles preferably constitute from 15 to 70%, more preferably from 40 to 75%, and most preferably from 40 to 60% by weight, of the cleaning composition.

The particle size of the sulfamic acid is preferably from 0.4 to 1.0 mm.

The citric acid preferably constitutes from 5 to 15% by weight of the cleaning composition. The particle size of the citric acid is preferably from 0.4 to 1.5 mm, but finer particles may also be used.

Sodium carbonate which acts as an effervescent agent in the cleaning composition of the invention constitutes from 10 to 30% by weight of the composition and is preferably present in an amount of from 15 to 25% by weight.

Examples of suitable surfactants are liquid, powdered, needle shaped or granular surfactants having suitable cleaning properties and being capable of generating a foam during or after the disintegration of the tablets in water without unduly impairing the disintegrating process.

The surfactants may be non-ionic, anionic, cationic or amphoteric. Particularly preferred are non-ionic surfactants of the fatty alcohol ethoxylate and/or alkylpolyglucoside type and anionic surfactants of the linear alkylbenzene sulphonate type (LAS) and of the fatty alcohol sulphate type (FAS).

An example of an alkylpolyglucoside type surfactant is a product sold under the trade name Glucopon 50 G by Cognis. An example of a LAS type surfactant is a product sold under the trade name Marlon APL by the company Condea and an example of a FAS type surfactant is a product sold under the name Sulphopon 1216 by the company Cognis.

The cleaning compositions according to the invention may contain up to 10% by weight of tabletting additives preferably in the form of a binder. Examples of such additives are polyethylene glycol sold under the trade name PEG 3350 from Clariant and sorbitol.

The cleaning composition preferably contains a disinfectant or bleaching agent in an amount of from 1 to 10% by weight.

The disinfectant/bleaching agent is preferably of an oxygen releasing type. A preferred disinfectant/bleaching agent is percarbonate such as a product marketed under the trade name Percarbonate S 131 by Solway.

The cleaning composition of the invention may contain up to 7% of a disintegrating agent which causes the tablets to disintegrate faster when added to water. A preferred disintegrating agent is a product marketed under the trade name Vivapur 200 by J. Rettenmaier und Söhne.

The cleaning composition of the invention may contain up to 5% by weight of conventional additives such as lubricants, stabilizing agents such as a polymer marketed under the trade name Sokalan CP 45, dyes, fragrances and oils such as paraffin oil.

The invention also relates to tablets prepared from a cleaning composition as described above.

The tablets of the invention may have any suitable shape and size and may be composed of more than one layer, e.g. 2–3 or even more layers.

Preferably tablets used for the cleaning of toilet bowls are cylindrical and have a diameter of from 20 to 50 mm or are of rectangular form having the dimensions 26×36 mm with a tablet weight of from 10 to 50 g. Particularly preferred rectangular form tablets have a weight of 25 g and a height of 17–20 mm.

The invention will now be described in further detail with reference to the following Table III which sets forth the composition and stability properties, viz tablet strength and disintegration time, of preferred embodiments or tablets of the invention.

The tablet strength is determined by placing a tablet on a plane surface and under a stainless steel piston having a diameter of 8 mm. The piston is then caused to move downwardly and into the surface of the tablet at a speed of 50 mm/min. The force exerted on the tablet by the piston is determined by a strain gauge and the maximum force detected during the penetration defines the tablet strength.

The disintegration time is determined by placing tablets in separate baskets made from a net having a mesh size of approximately 1 cm and placing said baskets in beakers containing 2 l water having a temperature of 20° C.

The time it takes for the tablets to disintegrate without stirring and to leave the basket determines the disintegration time.

TABLE III

| | Tablet No. 2 % by weight | Tablet No. 3 % by weight | Tablet No. 4 % by weight | Tablet No. 5 % by weight | Tablet No. 6 % by weight | Tablet No. 7 % by weight |
|---|---|---|---|---|---|---|
| Sulfamic acid particle size ≧ 0.4 mm | 52.63 | 57.63 | 57.63 | 62.63 | 65.13 | 65.13 |
| Citric acid | 10.00 | 5.00 | 5.00 | 5.00 | 5.00 | 5.00 |
| Sodium carbonate | 20.00 | 20.00 | 20.00 | 20.00 | 17.50 | 17.50 |
| Percarbnate | 2.00 | 2.00 | 2.00 | 2.00 | 2.00 | 2.00 |
| Dispersant | 2.00 | 2.00 | 2.00 | 2.00 | 2.00 | — |
| Surfactant (LAS) | 2.00 | 2.00 | — | — | — | — |
| Surfactant (FAS) | — | — | 2.00 | 2.00 | 2.00 | 2.00 |
| Binder | — | 5.25 | 5.25 | 2.75 | 2.75 | 4.75 |
| Sorbitol | 10.00 | — | — | — | — | — |
| Disintegrating agent | — | 5.00 | 5.00 | 2.50 | 2.50 | 2.50 |
| Dye | 0.02 | 0.02 | 0.02 | 0.02 | 0.02 | 0.02 |
| Perfume | 0.10 | 0.10 | 0.10 | 0.10 | 0.10 | 0.10 |
| Paraffin oil | 1.00 | 1.00 | 1.00 | 1.00 | 1.00 | 1.00 |
| Total | 100.00 | 100.00 | 100.00 | 100.00 | 100.00 | 100.00 |
| Tablet Strength, N | | | | | | |
| New tablets | 127 | 110 | 161 | 144 | 139 | 165 |
| After 24 hours | 155 | 163 | 228 | 182 | 159 | 207 |
| After 2 weeks[1)] | 334 | 291 | 436 | 417 | 397 | 388 |
| After 4 weeks[1)] | 353 | 374 | 530 | 587 | 496 | 326 |
| After 8 weeks[1)] | 120 | 298 | 584 | 640 | 498 | 84 |
| After 8 weeks at room temperature | 303 | 191 | 267 | 258 | 225 | 280 |
| Disintegration time, min. | | | | | | |
| New tablets | 2.00 | 4.47 | 3.00 | 2.00 | 1.42 | 2.33 |
| After 24 hours | 1.98 | 4.28 | 2.90 | 1.90 | 2.20 | 2.70 |
| After 2 weeks[1)] | 0.58 | 9.12 | 4.32 | 2.95 | 2.71 | 3.95 |
| After 4 weeks[1)] | 4.17 | 10.45 | 4.60 | 3.53 | 3.20 | 4.12 |
| After 8 weeks[1)] | 4.02 | 11.98 | 6.08 | 5.88 | 3.92 | 6.40 |
| After 8 weeks at room temperature | 2.63 | 7.53 | 4.02 | 2.23 | 2.10 | 3.45 |

[1)]Packed in a foil and stored at 75% relative humidity and 35° C.

What is claimed is:

1. A cleaning composition for production of cleaning tablets of enhanced stability, said composition comprising:

15–80% by weight of sulfamic acid having a particle size of from 0.4 to 1.4 mm;

5–60% by weight of citric acid powders;

10–30% by weight of sodium carbonate;

2–10% by weight of a tabletting additive;

up to 5% by weight of a tenside;

up to 10% by weight of an additive selected from the group consisting of disinfectants and bleeching agents;

up to 7% by weight of a disintegrating agent; and up to 5% by weight of conventional additives.

2. A cleaning composition according to claim 1 wherein the particle size of the sulfamic acid particles is from 0.4 to 1.0 mm.

3. A cleaning composition according to claim 1 wherein the citric acid powder constitutes from 5 to 15% by weight.

4. A cleaning composition according to claim 1 wherein the particle size of the citric acid powder is from 0.4 to 1.5 mm.

5. A cleaning composition according to claim 1 wherein the sodium carbonate constitutes from 15 to 25% by weight.

6. A cleaning composition according to claim 1 wherein the tabletting additive is a binder.

7. A cleaning composition according to claim 1 wherein the tenside is selected from the group consisting of non-ionic and anionic surfactants.

8. A cleaning composition according to claim 7 wherein the non-ionic surfactant is selected from a group consisting of fatty alcohol ethoxylates and alkylpolyglucosides.

9. A cleaning composition according to claim 7 wherein the anionic surfactant is selected from the group consisting of linear alkylbenzene sulphonate (LAS) and fatty alcohol sulphates (FAS).

10. A cleaning composition according to claim 1 which comprises percarbonate as disinfecting and bleaching agent.

11. A cleaning composition according to claim 1 which comprises microcrystalline cellulose as disintegrating agent.

12. A cleaning composition according to claim 1 which comprises a conventional additive selected from the group consisting of lubricants, stabilizing agents, dyes, fragrances and oil.

13. A cleaning tablet of enhanced stability prepared from a cleaning composition comprising:

15–80% by weight of sulfamic acid having a particle size of from 0.4 to 1.4 mm;

5–60% by weight of citric acid powder;

10–30% by weight of sodium carbonate;

2–10% by weight of a tabletting additive;

up to 5% by weight of a tenside;

up to 10% by weight of an additive selected from the group consisting of disinfectants and bleeching agents;

up to 7% by weight of a disintegrating agent; and up to 5% by weight of conventional additives.

14. A cleaning tablet according to claim 13 in the from of a cylinder having a diameter of from about 20 to about 50 mm.

15. A cleaning tablet according to claim 13 having a rectangular form.

* * * * *